US008864221B1

(12) United States Patent
Delvilla

(10) Patent No.: US 8,864,221 B1
(45) Date of Patent: Oct. 21, 2014

(54) FOLDING MASSAGE CHAIR

(71) Applicant: Antonio J. Delvilla, Miami, FL (US)

(72) Inventor: Antonio J. Delvilla, Miami, FL (US)

( * ) Notice: Subject to any disclaimer, the term of this patent is extended or adjusted under 35 U.S.C. 154(b) by 92 days.

(21) Appl. No.: 13/651,606

(22) Filed: Oct. 15, 2012

(51) Int. Cl.

| | |
|---|---|
| ***A47C 4/00*** | (2006.01) |
| ***A47C 7/50*** | (2006.01) |
| ***A47C 7/62*** | (2006.01) |
| ***A47C 7/66*** | (2006.01) |
| ***A47C 7/72*** | (2006.01) |
| ***A47C 7/74*** | (2006.01) |
| ***A47C 20/00*** | (2006.01) |

(52) U.S. Cl.
USPC ..... 297/31; 297/180.11; 297/180.12; 297/184.16; 297/188.12; 297/188.14; 297/188.21; 297/217.4; 297/423.26; 297/423.3

(58) Field of Classification Search
CPC ..... A47C 7/66; A47C 7/744; A47C 1/0265; A47C 7/74; A47C 7/72; A47C 7/50; A47C 1/14; A47C 7/62; A47C 4/286; A45C 15/00
USPC ..... 297/31, 180.11, 180.12, 184.1–184.17, 297/188.08–188.21, 217.4, 423.26, 423.3
See application file for complete search history.

(56) References Cited

U.S. PATENT DOCUMENTS

| | | | | | |
|---|---|---|---|---|---|
| 3,151,909 | A | * | 10/1964 | Gerdetz | 297/188.2 |
| 3,295,886 | A | * | 1/1967 | Goldmerstein | 297/180.14 |
| 4,201,416 | A | * | 5/1980 | Vanderminden | 297/184.15 |
| 4,474,407 | A | * | 10/1984 | Nazar | 297/188.13 |
| 4,487,345 | A | * | 12/1984 | Pierce et al. | 224/155 |
| 4,650,245 | A | * | 3/1987 | Nazar | 297/188.13 |
| 4,652,048 | A | * | 3/1987 | Nazar | 297/188.13 |
| 4,676,548 | A | * | 6/1987 | Bradbury | 297/129 |
| 4,725,094 | A | * | 2/1988 | Greer | 297/229 |
| 4,789,200 | A | * | 12/1988 | Munguia | 297/184.16 |
| 4,809,724 | A | * | 3/1989 | Fuser | 297/184.16 X |
| 4,853,992 | A | * | 8/1989 | Yu | 297/180.11 X |
| 4,871,141 | A | * | 10/1989 | Chen | 297/184.16 X |
| 4,923,248 | A | * | 5/1990 | Feher | 297/180.11 |
| 4,971,390 | A | * | 11/1990 | McGinley | 297/188.11 |
| 4,997,230 | A | * | 3/1991 | Spitalnick | 297/180.11 |
| 5,000,384 | A | | 3/1991 | Arnold | |
| 5,087,095 | A | * | 2/1992 | McFate | 297/188.08 X |
| 5,110,184 | A | * | 5/1992 | Stein et al. | 297/184.16 X |
| 5,350,215 | A | * | 9/1994 | DeMars | 297/188.14 |
| 5,356,160 | A | * | 10/1994 | Urlwin | 297/188.08 X |
| 5,368,359 | A | * | 11/1994 | Eakin | 297/184.14 X |
| 5,409,291 | A | * | 4/1995 | Lamb et al. | 297/188.12 X |
| 5,527,088 | A | * | 6/1996 | MacLean | 297/129 |
| 5,536,064 | A | * | 7/1996 | MacLean | 297/129 |
| 5,538,318 | A | * | 7/1996 | MacLean | 297/129 |
| 5,597,210 | A | * | 1/1997 | Pickard | 297/423.3 X |
| 5,641,197 | A | * | 6/1997 | Springmann | 297/188.11 |
| 5,733,000 | A | * | 3/1998 | Stump | 297/188.06 |
| 6,000,752 | A | * | 12/1999 | Shyr | 297/188.08 |

(Continued)

*Primary Examiner* — Rodney B White
(74) *Attorney, Agent, or Firm* — Crossley Patent Law; Micah C. Gunn

(57) ABSTRACT

A folding massage chair that includes a chair with attached front and rear support frames. The chair includes a seat portion and a backing portion, and also includes a massage and heating pad that is placed over the seat portion and a backing portion. The massage and heating pad includes a number of heating units and heating coils, along with a number of vibrator units. The chair also includes a cup holder and a music player holder, along with a foot rest attached to the front support frame. The chair also has a canopy that is attached to the backing portion.

3 Claims, 6 Drawing Sheets

(56) References Cited

U.S. PATENT DOCUMENTS

| | | | | |
|---|---|---|---|---|
| 6,017,085 | A * | 1/2000 | LaCroix et al. | 297/188.15 X |
| 6,036,262 | A * | 3/2000 | Shahid | 297/184.15 X |
| 6,048,023 | A * | 4/2000 | Lampton | 297/129 |
| 6,056,172 | A * | 5/2000 | Welsh | 224/155 |
| 6,189,967 | B1 * | 2/2001 | Short | 297/180.11 X |
| 6,234,187 | B1 * | 5/2001 | Izzo | 135/98 |
| 6,375,258 | B1 * | 4/2002 | Fang | 297/188.08 |
| 6,382,727 | B1 * | 5/2002 | Pickard | 297/423.3 X |
| 6,402,231 | B1 * | 6/2002 | Pedemonte | 297/188.13 X |
| 6,471,289 | B2 * | 10/2002 | Aguilar | 297/184.16 |
| 6,494,534 | B1 * | 12/2002 | Li | 297/180.11 X |
| 6,520,574 | B1 * | 2/2003 | Huang | 297/184.16 |
| 6,523,894 | B1 * | 2/2003 | Mellace | 297/188.19 |
| 6,623,072 | B1 * | 9/2003 | Mellace | 297/188.19 X |
| 6,739,652 | B2 * | 5/2004 | Welsh | 297/188.14 X |
| 6,764,132 | B1 * | 7/2004 | Gaertner | 297/183.5 |
| 6,764,133 | B2 * | 7/2004 | Osato | 297/184.13 X |
| D494,769 | S | 8/2004 | Vigneaud | |
| 6,789,557 | B1 * | 9/2004 | Wahl, Jr. | 297/184.11 X |
| 6,935,694 | B2 * | 8/2005 | Turner | 297/188.14 X |
| RE39,022 | E * | 3/2006 | Welsh | 224/155 |
| 7,118,172 | B1 * | 10/2006 | Pattison-Sheets | 297/184.15 X |
| 7,147,277 | B1 * | 12/2006 | Miller | 297/19 |
| 7,226,126 | B1 * | 6/2007 | Spanovich | 297/184.16 X |
| 7,229,131 | B2 * | 6/2007 | Chen | 297/217.4 |
| 7,249,799 | B2 * | 7/2007 | Luce | 297/188.18 |
| 7,395,828 | B1 * | 7/2008 | Pulley | 297/184.16 X |
| 7,438,355 | B2 * | 10/2008 | Pedemonte | 297/188.13 X |
| 7,527,330 | B2 * | 5/2009 | Montpas | 297/184.15 |
| 7,562,930 | B1 * | 7/2009 | Rondeau | 297/184.16 |
| 7,641,279 | B1 * | 1/2010 | Curcio | 297/188.18 |
| 7,815,254 | B2 | 10/2010 | Reeb et al. | |
| 8,061,766 | B2 * | 11/2011 | Miller | 297/60 |
| 8,123,290 | B1 * | 2/2012 | Aiken et al. | 297/180.11 X |
| 8,297,695 | B1 * | 10/2012 | Aiken et al. | 297/180.11 X |
| 8,388,056 | B2 * | 3/2013 | Smith et al. | 297/180.12 |
| 8,465,090 | B1 * | 6/2013 | O'Connor | 297/184.16 X |
| 8,585,135 | B2 * | 11/2013 | Wilson | 297/423.3 X |
| 2002/0125748 | A1 * | 9/2002 | Aguilar | 297/184.16 |
| 2004/0075310 | A1 * | 4/2004 | Wang | 297/184.11 |
| 2007/0296251 | A1 * | 12/2007 | Krobok et al. | 297/180.11 |
| 2008/0100107 | A1 * | 5/2008 | Paslawski | 297/217.4 |
| 2009/0072594 | A1 * | 3/2009 | Korytowski | 297/180.12 |
| 2010/0207429 | A1 | 8/2010 | Quinn | |
| 2011/0181078 | A1 * | 7/2011 | Kelly et al. | 297/184.1 X |
| 2012/0313405 | A1 * | 12/2012 | Eckman et al. | 297/180.12 |
| 2013/0328362 | A1 * | 12/2013 | Miller | 297/188.2 |

* cited by examiner

FOLDING MASSAGE CHAIR

BACKGROUND OF THE INVENTION

Various types of folding massage chairs are known in the prior art. However, what is needed is a folding massage chair that combines an outdoor deck chair with a massage chair.

FIELD OF THE INVENTION

The present invention relates to a folding massage chair, and more particularly, to a folding massage chair that provides features and characteristics above and beyond existing folding massage chairs.

SUMMARY OF THE INVENTION

The general purpose of the present folding massage chair, described subsequently in greater detail, is to provide a folding massage chair which has many novel features that results in a folding massage chair which is not anticipated, rendered obvious, suggested, or even implied by prior art, either alone or in combination thereof.

The folding massage chair disclosed herein has a chair with attached front and rear support frames. The chair includes a seat portion and a backing portion, and also includes a massage and heating pad that is placed over the seat portion and a backing portion. The massage and heating pad includes a number of heating units and heating coils, along with a number of vibrator units. The chair also includes a cup holder and a music player holder, along with a foot rest attached to the front support frame. The chair also has a canopy that is attached to the backing portion.

Thus has been broadly outlined the more important features of the present folding massage chair so that the detailed description thereof that follows may be better understood and in order that the present contribution to the art may be better appreciated.

DETAILED DESCRIPTION OF THE DRAWINGS

Figure 1:
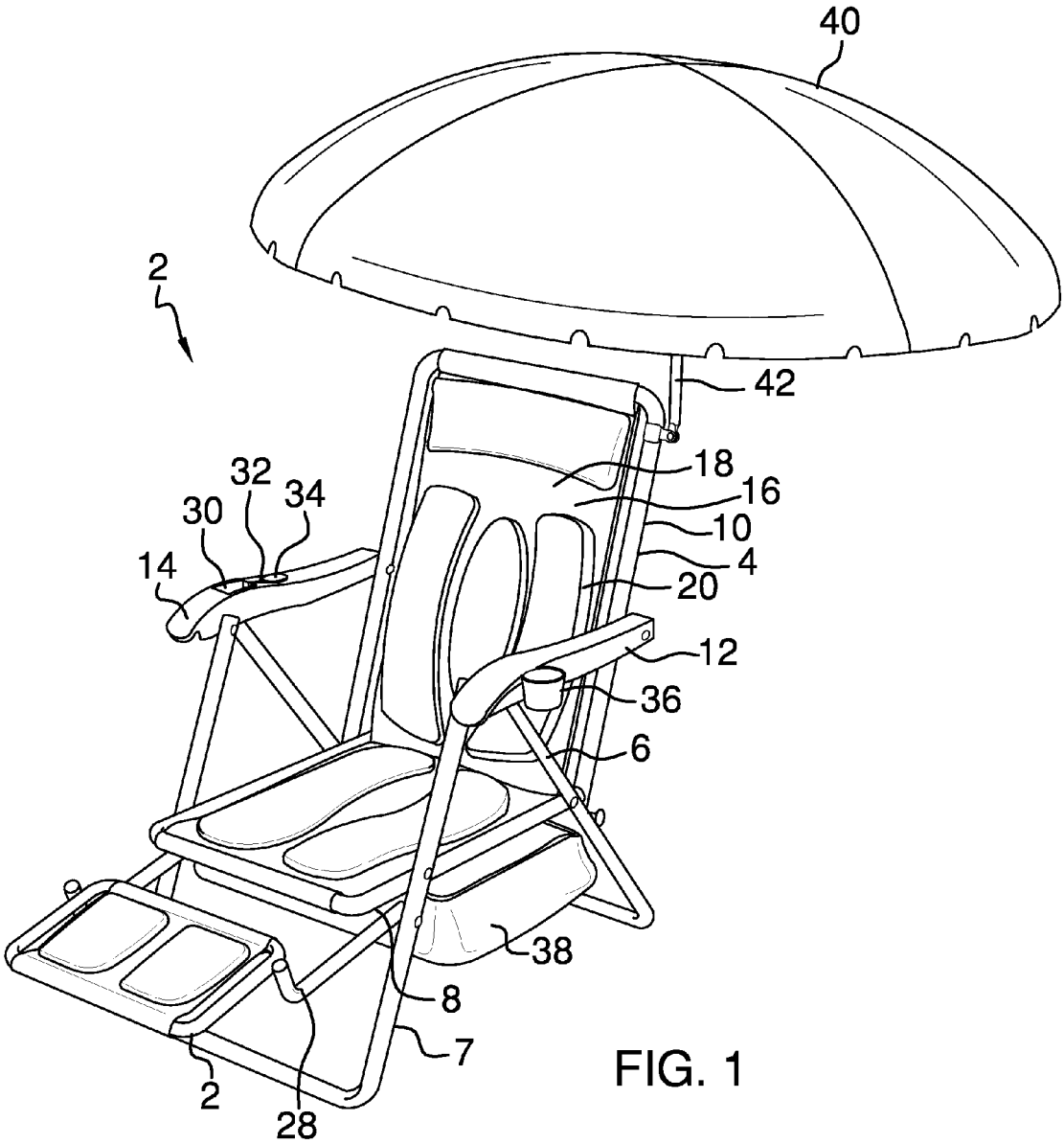
FIG. 1 is a perspective view of the folding massage chair.
Figure 2:
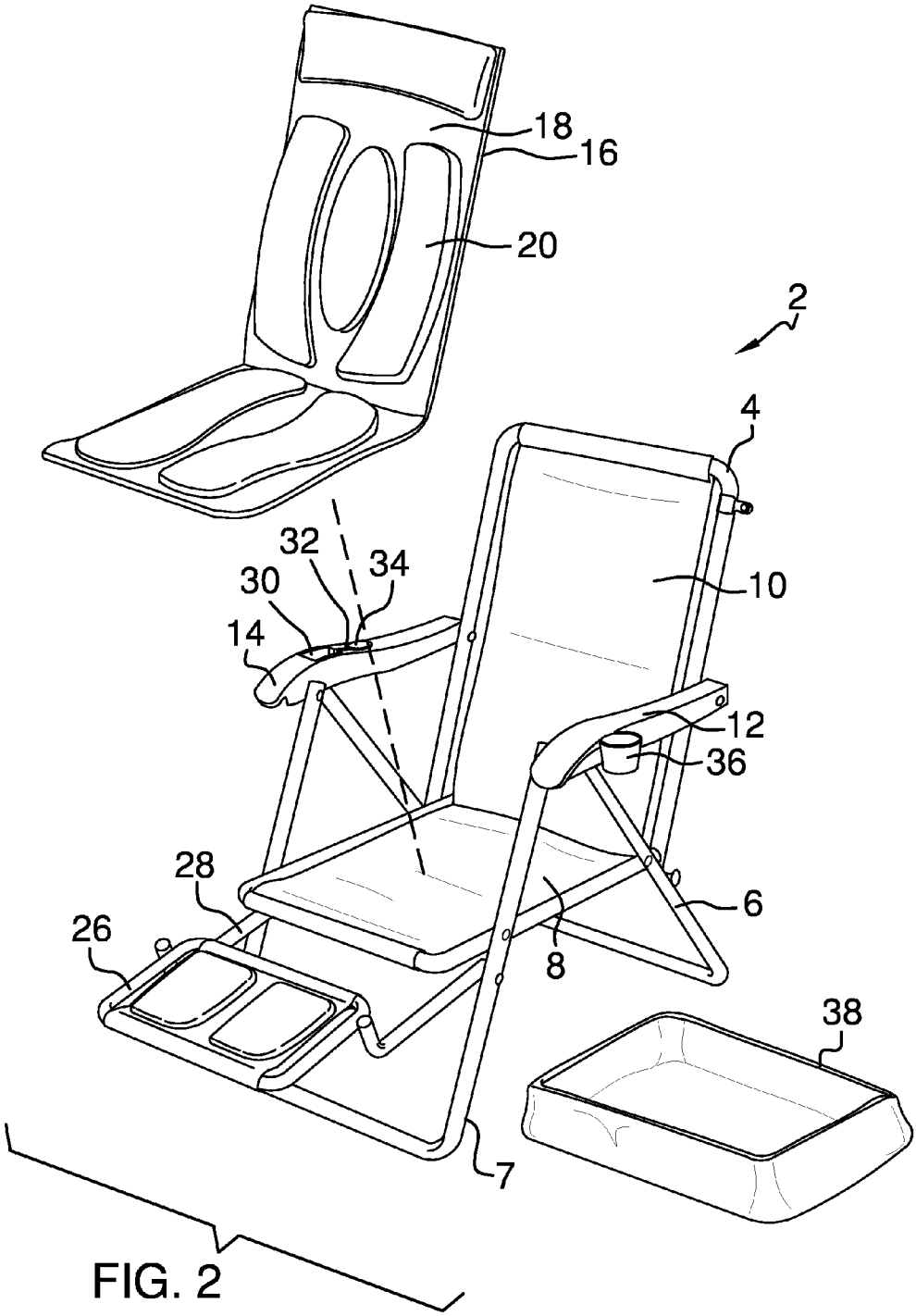
FIG. 2 is an exploded view of the folding massage chair.
Figure 3:
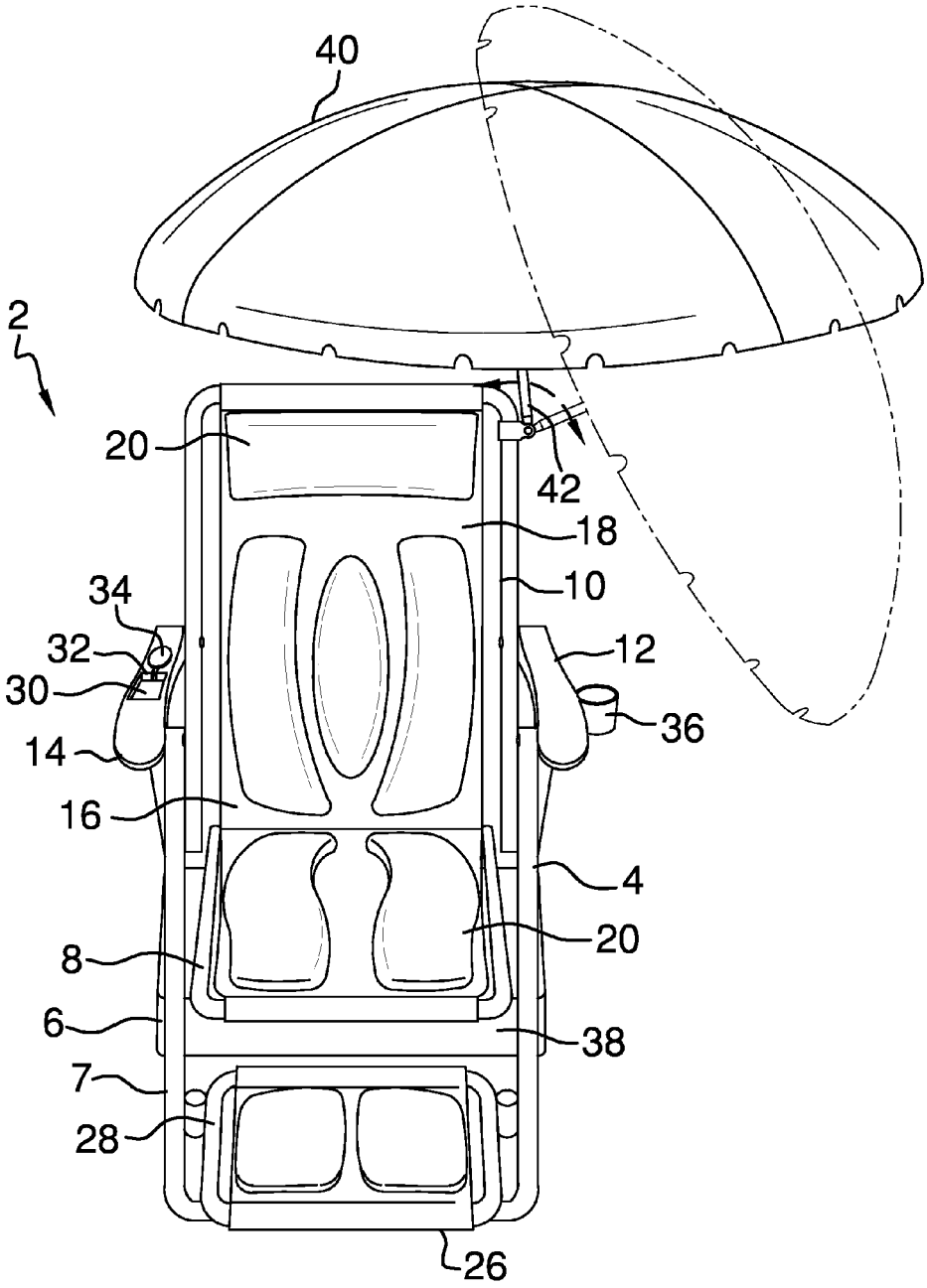
FIG. 3 is a front view of the folding massage chair.
Figure 4:
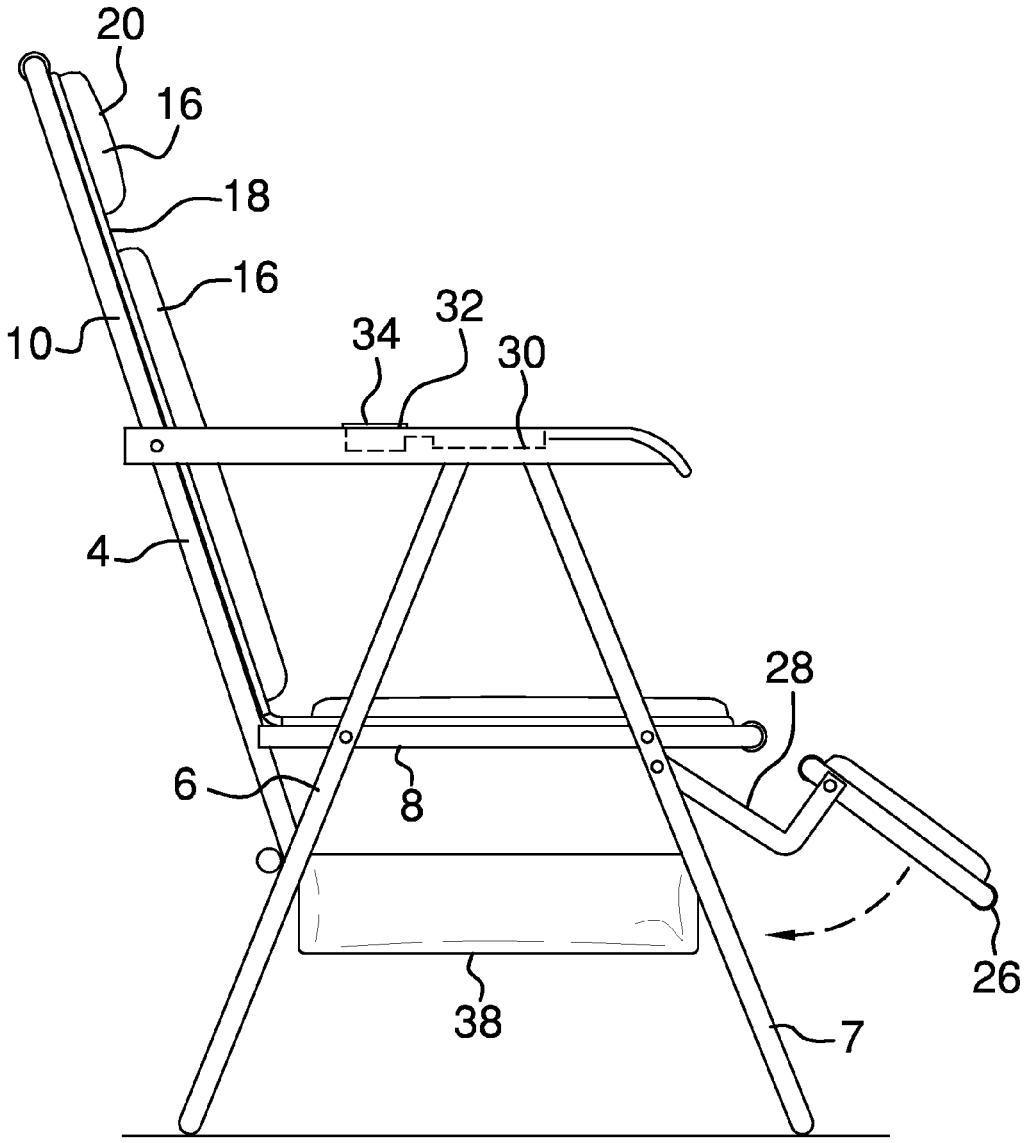
FIG. 4 is a side view of the folding massage chair.
Figure 5:
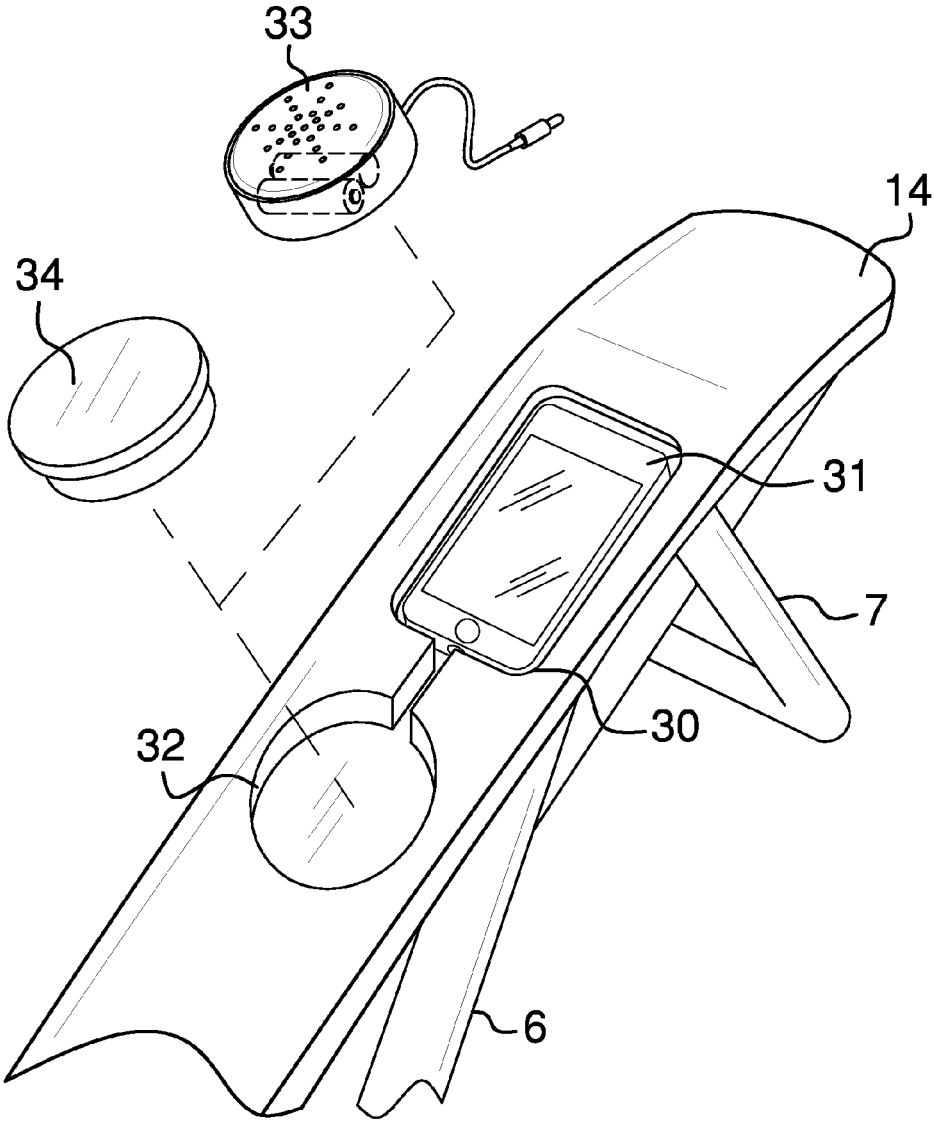
FIG. 5 is a detailed view of the folding massage chair.
Figure 6:
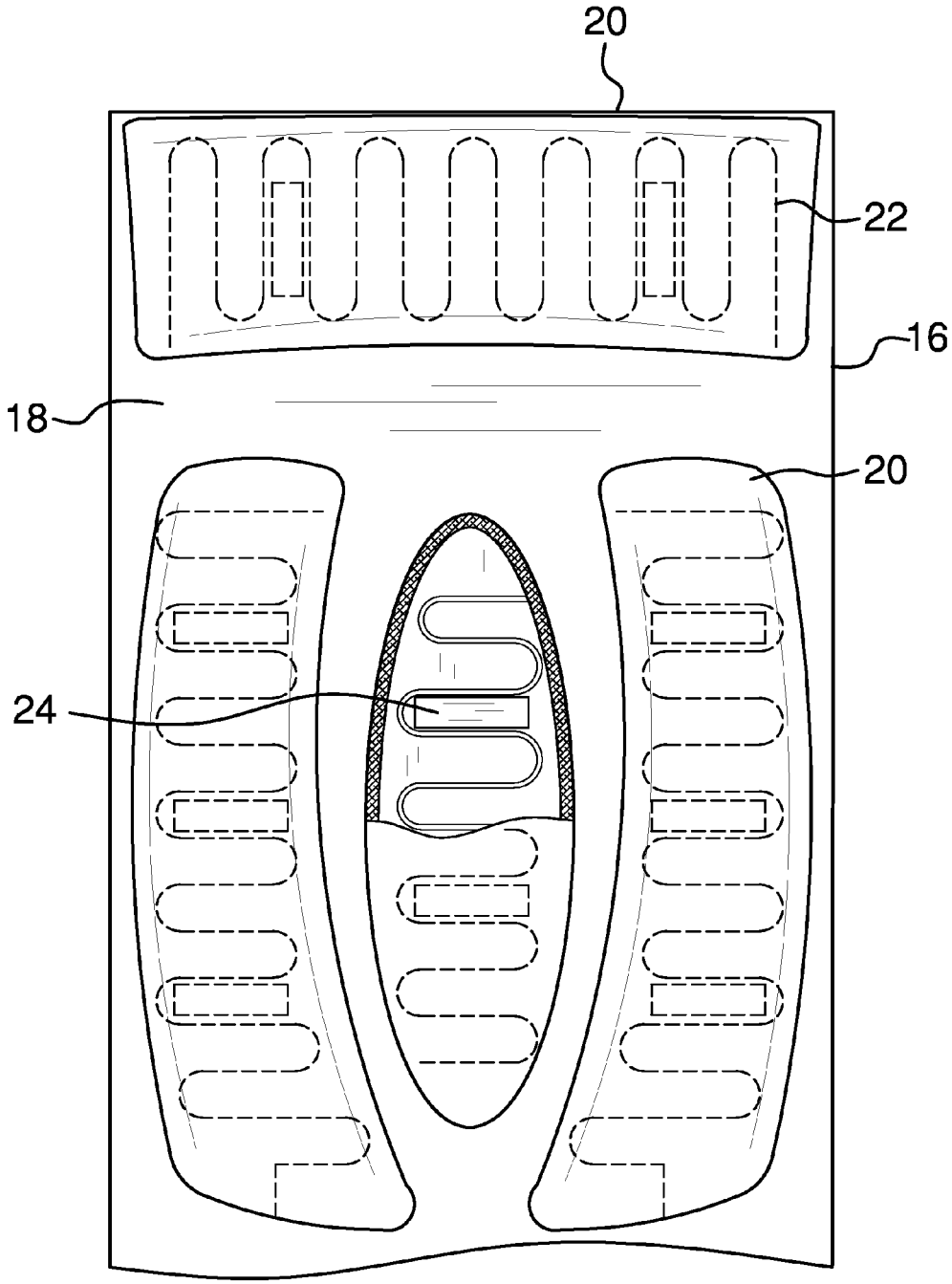
FIG. 6 is a cross-sectional view of the folding massage chair.

With reference now to the drawings, and in particular FIGS. 1 through 6 thereof, an example of the folding massage chair employing the principles and concepts of the present folding massage chair and generally designated by the reference number 2 will be described.

Referring to FIGS. 1 through 6, a preferred embodiment of the present folding massage chair 2 is illustrated. The folding massage chair 2 disclosed herein comprises a chair 4, with the chair 4 including a rear support frame 6 and a front support frame 7. The chair 4 roughly comprises two portions, which includes a seat portion 8 and a backing portion 10 that is connected to the seat portion 8. The seat portion 8 is connected to both the rear support frame 6 and a front support frame 7.

The chair also includes a left armrest 12 and a right armrest 14, with each of these armrests being connected to both the rear support frame 6 and the front support frame 7. A massage and heating pad 16 is placed over the seat portion 8 and backing portion 10 of the chair 2. The massage and heating pad 16 is fabricated from a backing 18 and has a number of heating units 20 and heating coils 22 attached to the backing 18. Furthermore, a number of vibrators 24 are attached to the massage and heating pad 16 as well.

Chair 2 also includes footrest 26, which is pivotally attached to the front support frame 7 via attachment 28.

Right armrest 14 includes a music player holder 30 and a speaker holder 32, which are two compartments that are adjacent to one another. Music player holder 30 is designed to hold a music player 31, while speaker holder 32 is designed to hold a speaker 33. Cover 34 is placed over speaker holder 32 when items within speaker holder 32 are not being accessed. Left armrest 12 includes a cup holder 36, which is fixedly attached. The placement of the music player holder 30, speaker holder 32, and cup holder 36 can be adjusted accordingly depending on the needs of a particular user or for space concerns.

A cooler 38 is placed underneath the seat portion 8 of the chair 2 and is removably connected to the rear support frame 6 and front support frame 7. Chair 2 also comes with a canopy 40, which is removably attached to the backing portion 10 via attachment 42. Canopy 40 can be utilized to help protect an individual from the sun or wind while the chair 2 is being used.

What is claimed is:

1. A folding massage chair comprising:

a chair, the chair further comprising a rear support frame;

a front support frame;

a seat portion, wherein the seat portion is connected to the rear support frame, further wherein the seat portion is connected to the front support frame;

a backing portion, wherein the backing portion is connected to the seat portion;

a pair of armrests, wherein the pair of armrests further comprises a left armrest;

a right armrest;

wherein each of the armrests is connected to the rear support frame, further wherein each of the armrests is connected to the front support frame;

a massage and heating pad, wherein the massage and heating pad further comprises a backing;

a plurality of heating units attached to the backing;

a plurality of heating coils attached to the backing;

a speaker holder, wherein the speaker holder is located on an armrest of the pair of armrests;

a cover, wherein the cover is located over the speaker holder;

an attachment, wherein the attachment is pivotally attached to the front support frame;

a footrest, wherein the footrest is connected to the front support frame by the attachment;

a cooler;

a canopy;

a plurality of vibrators;

a cup holder, wherein the cup holder is located on an armrest of the pair of armrests; and a music player holder;

wherein the cooler is removably attached to the rear support frame;

further wherein the cooler is removably attached to the front support frame;

wherein the massage and heating pad is placed over the chair;

wherein the music player holder is located on an armrest of the pair of armrests;

wherein the canopy is fixedly attached to the backing portion; and wherein the vibrators are attached to the massage and heating pad.

2. A folding massage chair comprising:

a chair, the chair further comprising a rear support frame;

a front support frame;

a seat portion, wherein the seat portion is connected to the rear support frame, further wherein the seat portion is connected to the front support frame;

a backing portion, wherein the backing portion is connected to the seat portion;

a pair of armrests, wherein the pair of armrests further comprises a left armrest;

a right armrest;

a massage and heating pad, wherein the massage and heating pad further comprises a backing;

a plurality of heating units attached to the backing;

a plurality of heating coils attached to the backing;

a cup holder, wherein the cup holder is located on an armrest of the pair of armrests;

a music player holder;

a speaker holder, wherein the speaker holder is located on an armrest of the pair of armrests;

a cover, wherein the cover is located over the speaker holder;

an attachment, wherein the attachment is pivotally attached to the front support frame;

a footrest, wherein the footrest is connected to the front support frame by the attachment;

a cooler;

a canopy;

a plurality of vibrators;

wherein the cooler is removably attached to the rear support frame;

wherein the cooler is removably attached to the front support frame;

wherein the canopy is fixedly attached to the backing portion;

wherein the massage and heating pad is placed over the chair;

wherein each of the armrests is connected to the rear support frame, further wherein each of the armrests is connected to the front support frame;

wherein the music player holder is located on an armrest of the pair of armrests;

wherein the vibrators are attached to the massage and heating pad; and wherein the music player holder and the speaker holder are located adjacent to one another.

3. A folding massage chair comprising:

a chair, the chair comprising a rear support frame;

a front support frame;

a seat portion; wherein the seat portion is connected to the rear support frame, further wherein the seat portion is connected to the front support frame;

a backing portion, wherein the backing portion is connected to the seat portion;

a pair of armrests, wherein the pair of armrests further comprises a left armrest;

a right armrest;

wherein each of the armrests is connected to the rear support frame, further wherein each of the armrests is connected to the front support frame;

a massage and heating pad, wherein the massage and heating pad further comprises a backing;

a plurality of heating units attached to the backing;

a plurality of heating coils attached to the backing;

wherein the massage and heating pad is placed over the chair;

an attachment, wherein the attachment is pivotally attached to the front support frame;

a footrest, wherein the footrest is connected to the front support frame by the attachment;

a music player holder, wherein the music player holder is located on an armrest of the pair of armrests;

a speaker holder, wherein the speaker holder is located is located on an armrest of the pair of armrests;

a cover, wherein the cover is located over the speaker holder;

a cup holder, wherein the cup holder is located on an armrest of the pair of armrests;

a cooler, wherein the cooler is removably attached to the rear support frame, further wherein the cooler is removably attached to the front support frame, a canopy, wherein the canopy is fixedly attached to the backing portion;

a plurality of vibrators, wherein the vibrators are attached to the massage and heating pad;

wherein the music player holder and the speaker holder are located adjacent to one another.

* * * * *